US011163260B2

(12) United States Patent
Katsumata

(10) Patent No.: US 11,163,260 B2
(45) Date of Patent: Nov. 2, 2021

(54) IMAGE FORMING APPARATUS CAPABLE OF SUPPRESSING ENTRANCE OF TONER FROM A LIGHT GUIDING MEMBER SIDE INTO A LIGHT SOURCE

(71) Applicant: CANON KABUSHIKI KAISHA, Tokyo (JP)

(72) Inventor: Go Katsumata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/178,649

(22) Filed: Feb. 18, 2021

(65) Prior Publication Data

US 2021/0263465 A1 Aug. 26, 2021

(30) Foreign Application Priority Data

Feb. 25, 2020 (JP) ..... JP2020-029865

(51) Int. Cl.

| | |
|---|---|
| ***G03G 21/00*** | (2006.01) |
| ***G03G 21/06*** | (2006.01) |
| ***G03G 21/16*** | (2006.01) |
| ***G03G 21/18*** | (2006.01) |
| ***G03G 15/16*** | (2006.01) |

(52) U.S. Cl.

CPC ..... *G03G 21/1671* (2013.01); *G03G 15/169* (2013.01); *G03G 21/0094* (2013.01); *G03G 21/1814* (2013.01)

(58) Field of Classification Search

CPC .... G03G 21/0094; G03G 21/06; G03G 21/08; G03G 21/1671

USPC ..... 399/111, 116, 128

See application file for complete search history.

(56) References Cited

U.S. PATENT DOCUMENTS

| | | | | |
|---|---|---|---|---|
| 6,678,491 | B2 | 1/2004 | Kido et al. | |
| 8,064,799 | B2 * | 11/2011 | Tanaka et al. | G03G 21/08 399/128 |
| 9,367,031 | B2 * | 6/2016 | Wada | G03G 21/1814 |
| 9,501,033 | B2 * | 11/2016 | Abe et al. | G03G 21/0094 |

FOREIGN PATENT DOCUMENTS

| | | |
|---|---|---|
| JP | 2002-278395 A | 9/2002 |

* cited by examiner

*Primary Examiner* — William J Royer

(74) *Attorney, Agent, or Firm* — Venable LLP

(57) ABSTRACT

An image forming apparatus includes a photosensitive member, a light source, a light guiding unit including a light guiding member, a casing portion provided with a first through-hole, and a sheet-like elastic member provided with a second through-hole. The light guiding unit penetrates the first through-hole and the second through-hole, and one end portion of the light guiding unit opposes the light source and is positioned inside the casing portion. At a flat surface of the light guiding unit perpendicular to a longitudinal direction of the light guiding unit, an area of the second through-hole is smaller than an area of the light guiding unit.

11 Claims, 19 Drawing Sheets

IMAGE FORMING APPARATUS CAPABLE OF SUPPRESSING ENTRANCE OF TONER FROM A LIGHT GUIDING MEMBER SIDE INTO A LIGHT SOURCE

FIELD OF THE INVENTION AND RELATED ART

The present invention relates to an image forming apparatus such as a copying machine, a printer, a facsimile machine or a multi-function machine having a plurality of functions of these machines.

As the image forming apparatus, a constitution in which a drum cartridge including a photosensitive drum as a photosensitive member or a process cartridge is mountable and dismountable from an apparatus main assembly has been conventionally known. Further, a constitution in which an optical discharging device for removing electric charges on the photosensitive drum by irradiating a surface of the photosensitive drum with light has also been known (Japanese Laid-Open Patent Application (JP-A) 2002-278395).

JP-A 2002-278395 discloses a constitution in which a light guiding member for guiding light of a light source provided in an apparatus main assembly to the surface of the photosensitive drum is provided and in which a process cartridge mountable in and dismountable from the apparatus main assembly is provided. Further, JP-A 2002-278395 discloses a constitution in which a periphery of the light source is covered with a light blocking member comprising an elastic member and thus leakage of light of the light source to an outside is suppressed. In the case of such a constitution disclosed in JP-A 2002-278395, when the process cartridge is mounted in the apparatus main assembly, an end portion of the light guiding member contacts the light blocking member, so that the light blocking member is expanded and contracted.

When the light blocking member comprising the elastic member is contacted to the light guiding member, it is possible to suppress toner from entering the light source from the light guiding member side. However, in a constitution in which the light blocking member abuts against the light guiding member and is elastically deformed, high part accuracy is required for ensuring a region where light traveling through the light guiding member is received. Therefore, it is desired to provide a constitution in which the toner does not readily enter the light source from the light guiding member side with a simple structure.

SUMMARY OF THE INVENTION

A principal object of the present invention is to provide an image forming apparatus capable of suppressing entrance of toner from a light guiding member side into a light source with a simple structure.

According to an aspect of the present invention, there is provided an image forming apparatus comprising: a photosensitive member on which an electrostatic image is formed; a light source; a light guiding unit including a light guiding member configured to guide light from the light source so that the light enters one end portion of the light guiding unit with respect to a longitudinal direction of the light guiding unit and travels toward the photosensitive member so as to optically discharge the photosensitive member; a casing portion provided with a first through hole and configured to cover the light source; and a sheet-like elastic member which is provided on a surface of the casing portion where the first through hole is provided and which is provided with a second through hole, wherein the light guiding unit penetrates the first through hole and the second through hole, and the one end portion of the light guiding unit opposes the light source and is positioned inside the casing portion, and wherein in a flat surface of the light guiding unit perpendicular to the longitudinal direction of the light guiding unit, an area of the second through hole is smaller than an area of the light guiding unit.

Further features of the present invention will become apparent from the following description of exemplary embodiments with reference to the attached drawings.

DESCRIPTION OF THE EMBODIMENTS

First Embodiment

Figure 1:
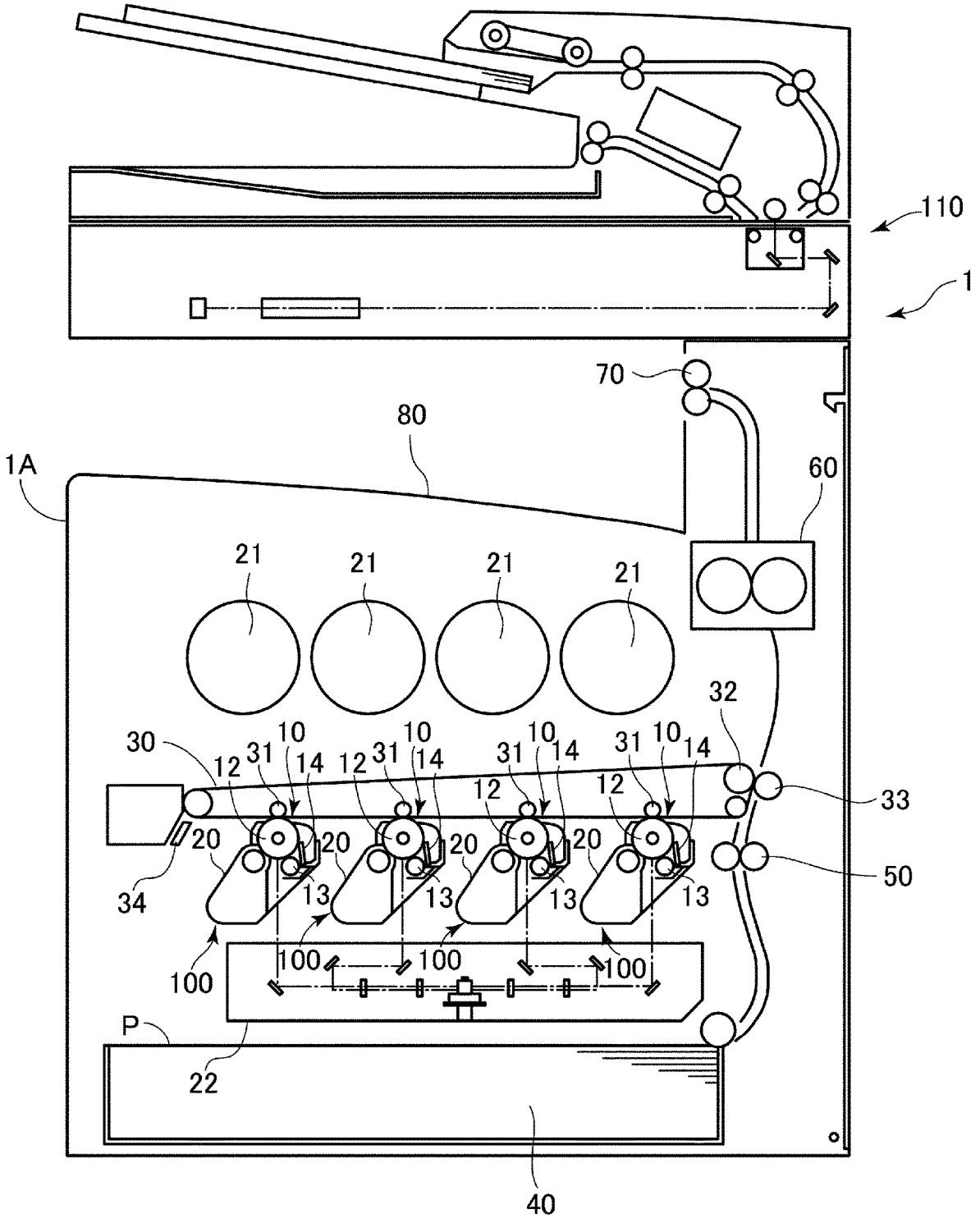
FIG. 1 is a schematic sectional view of an image forming apparatus according to a first embodiment.

A first embodiment will be described with reference to FIGS. 1 to 14. First, a general structure of an image forming apparatus according to this embodiment will be described using FIG. 1.

[Image Forming Apparatus]

An image forming apparatus 1 of this embodiment is a tandem full-color printer of an electrophotographic type in which four image forming portions 100, each including a photosensitive drum 12 as an image bearing member, are provided. The image forming apparatus 1 forms an image on a recording material in accordance with an image signal from an original reading device 110 connected to an apparatus main assembly 1A or from a host device such as a personal computer communicatably connected to the apparatus main assembly 1A. As the recording material, it is possible to cite a sheet, a plastic film, a cloth or the like. In the following, the recording material is described as the sheet. Further, the four image forming portions 100 form toner images of yellow, magenta, cyan and black, respectively. The four image forming portions 100 of the image forming apparatus 1 substantially have the same constitution except that development colors are different from each other.

The image forming portion 100 includes a drum cartridge (photosensitive (member) unit) 10 including the photosensitive drum 12 as a photosensitive member and includes a developing device 20. The photosensitive drum 12 is a cylindrical photosensitive member and rotates in the clockwise direction of FIG. 1. A surface of the photosensitive drum 12 is electrically charged uniformly by a charging roller 13 as a charging device, and thereafter is exposed to light by a laser scanner 22 as an exposure device driven on the basis of an image information signal which has been transmitted, so that an electrostatic latent image is formed on the surface of the photosensitive drum 12. The electrostatic latent image is visualized (developed) into the toner image by the developing device 20. The toner images on the photosensitive drums 12 of the respective image forming portions 100 are successively transferred onto an intermediary transfer belt 30 as an intermediary transfer member by being supplied with predetermined pressure and a predetermined electrostatic load bias by a primary transfer roller 31. After the transfer, slight residual toner remaining on the photosensitive drum 12 is removed and collected by a cleaning blade 14, and the photosensitive drum 12 prepared for subsequent image formation. Further, to the developing device 20, toner is supplied from a toner cartridge 21.

On the other hand, sheets P are fed one by one from a feeding cassette 40, and the sheet P is conveyed to a registration roller pair 50. The sheet P forms a loop by following a nip of the registration roller pair 50, so that oblique movement of the sheet P is rectified. Thereafter, the registration roller pair 50 is timed to the toner images on the intermediary transfer belt 30 and feeds the sheet P to a nip between the intermediary transfer belt 30 and an outer secondary transfer roller 33. The color toner images on the intermediary transfer belt 30 are transferred onto the sheet P under application of predetermined pressure and predetermined electrostatic load bias in the nip between the outer secondary transfer roller 33 and the intermediary transfer belt 30 through which a driving roller 32 opposes the secondary transfer roller 33. After the transfer, slight residual toner remaining on the intermediary transfer belt 30 is removed and collected by a cleaning blade 34, and the intermediary transfer belt 30 prepares for subsequent image formation. The toner images transferred on the sheet P are heated and pressed by a fixing device 60 and the sheet P is discharged onto a discharge tray 80 by a discharging roller pair 70.

[Drum Cartridge]

Figure 2:
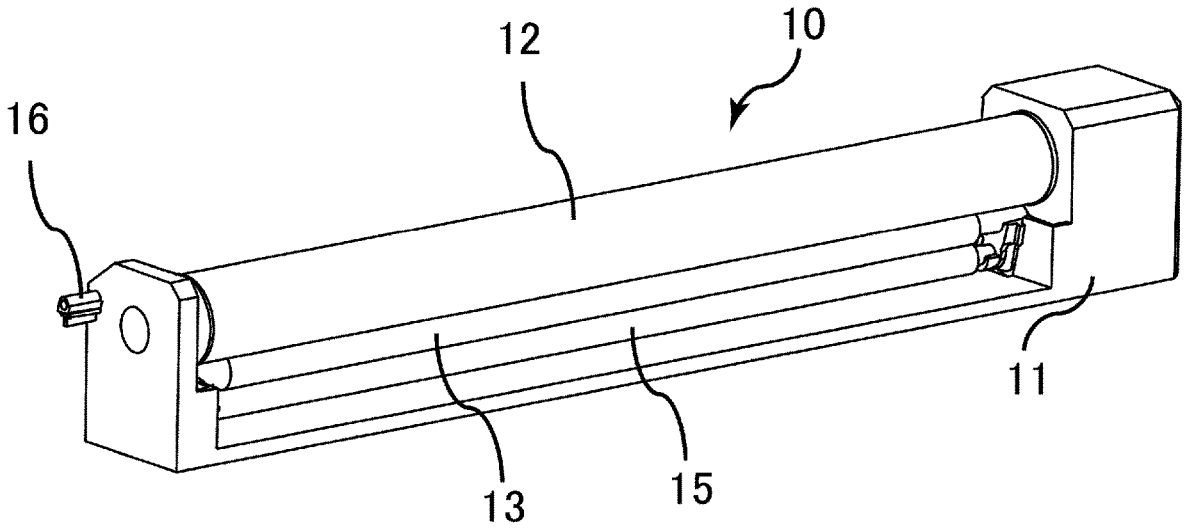
FIG. 2 is a perspective view of a drum cartridge in the first embodiment.
Figure 3:
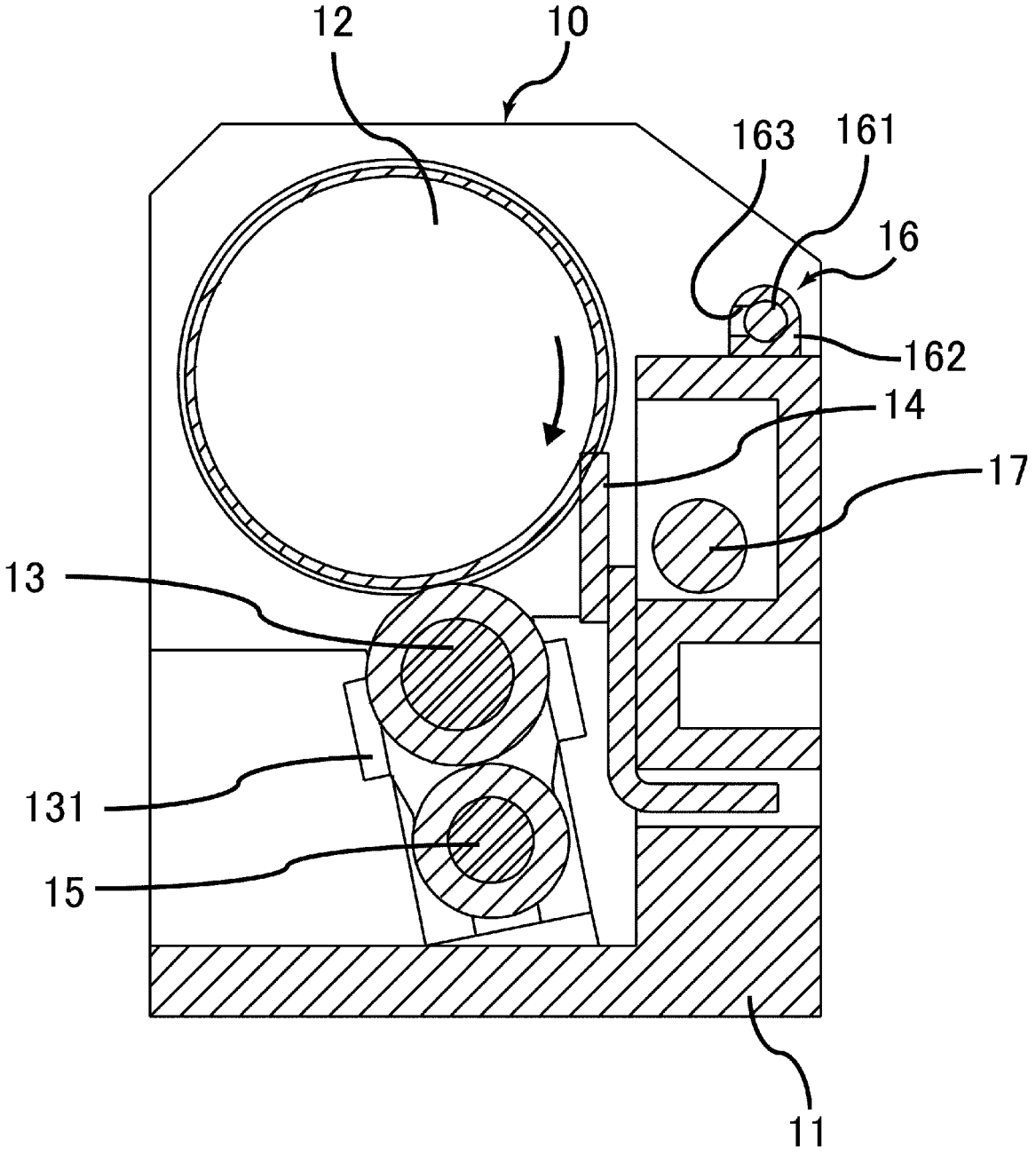
FIG. 3 is a schematic sectional view of the drum cartridge in the first embodiment.

Next, a structure of the drum cartridge 10 will be described using FIGS. 2 to 6. As shown in FIGS. 2 and 3, the drum cartridge 10 as the photosensitive unit includes the photosensitive drum 12, the charging roller 13, the cleaning blade 14 and a cleaning roller 15, and these members are integrally held by a drum container 11. The drum container 11 as a photosensitive member container accommodates the photosensitive drum 12, the charging roller 13, the cleaning blade 14 and the cleaning roller 15.

Such a drum cartridge 10 is mountable and dismountable from the apparatus main assembly 1A (FIG. 1) and is exchangeable during maintenance or the like. In the case of this embodiment, the drum cartridge 10 is capable of being inserted in and extracted from the apparatus main assembly 1A along a rotational axis direction of the photosensitive drum 12.

Figure 4:
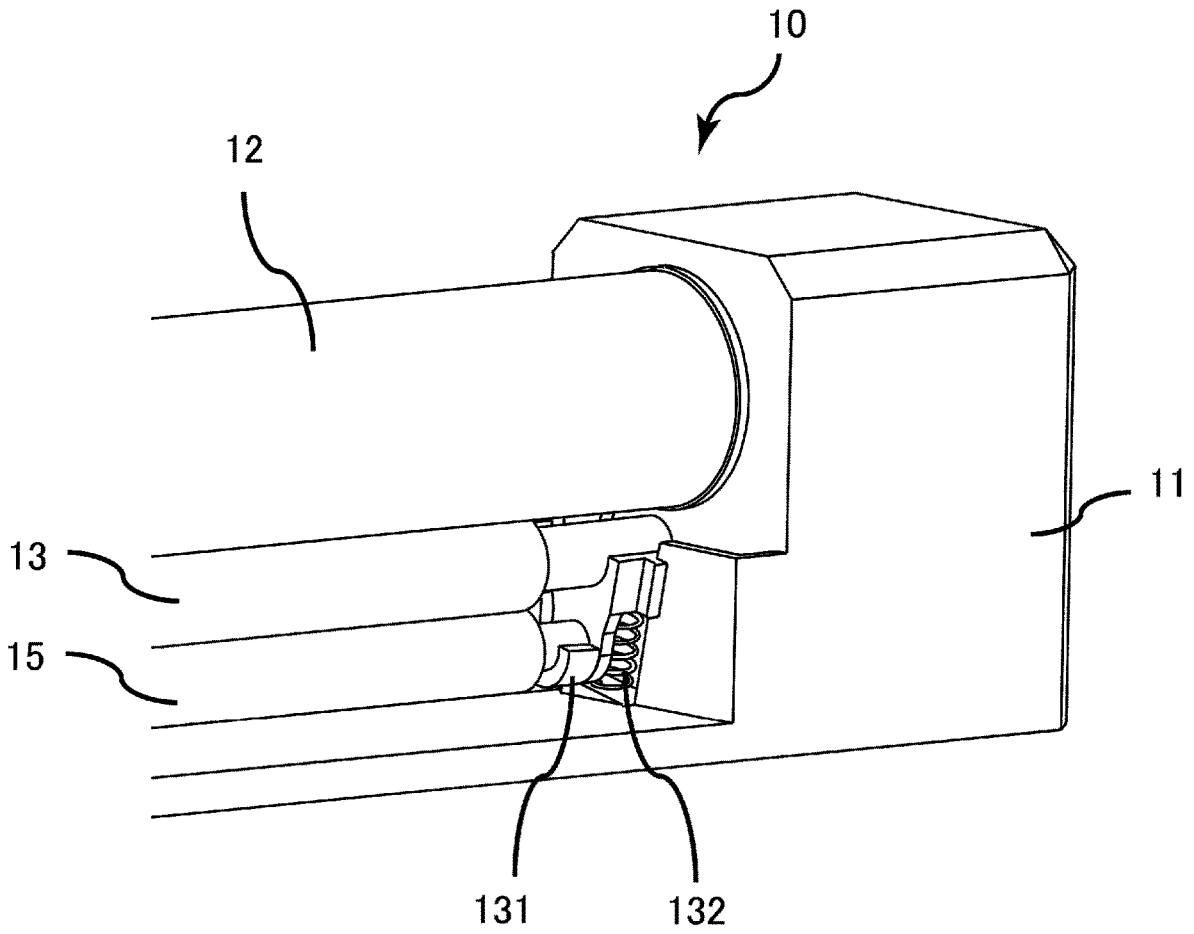
FIG. 4 is an enlarged perspective view of a part of the drum cartridge in the first embodiment.

By the drum container 11, the photosensitive drum 12 is rotatably held through unshown bearings, and the photosensitive drum 12 is provided with an unshown coupling for being rotated by receiving drive (driving force) from the apparatus main assembly 1A. As shown in FIG. 4, the charging roller 13 and the cleaning roller 15 are rotatably supported by bearings 131 and are urged toward the photosensitive drum 12 by urging springs 132. When the photosensitive drum 12 is rotated by receiving the drive from the apparatus main assembly 1A, the charging roller 13 is rotated by a frictional force between itself and the photosensitive drum 12, and when the charging roller 13 is rotated, the cleaning roller 15 is rotated by a frictional force between itself and the charging roller 13. By this, a surface of the charging roller 13 is cleaned by the cleaning roller 15.

Further, as shown in FIG. 3, to the drum container 11, the cleaning blade 14 is fixed. In the neighborhood of the cleaning blade 14, a feeding coil 17 for feeding the toner collected by the cleaning blade 14 and for discharging the toner from the drum cartridge 10 to the apparatus main assembly 1A is provided. The feeding coil 17 is disposed in a feeding passage formed by the drum container 11. On one end of the feeding coil 17, an unshown feeding driving gear for rotating the feeding coil 17 is provided, and the feeding driving gear is drive-connected to the photosensitive drum 12 by an unshown driving train.

Further, to the drum container 11, a light guiding unit 16 having a function as an optical discharging device 200 (FIG. 13) is fixed. The optical discharging device 200 includes the light guiding unit 16 described below, a light source unit 201 and a sealing member 240 which are described later. The optical discharging device 200 in this embodiment irradiates, with light, the surface of the photosensitive drum 12 after the toner image is transferred from the photosensitive drum 12 onto the intermediary transfer belt 30, so that residual electric charges on the photosensitive drum 12 are removed.

When the subsequent image formation is carried out while the residual electric charges remain on the surface of the photosensitive drum 12, the residual electric charges remain as an after-image on the image in some cases, but by removing the residual electric charges by the optical discharging device 200, image defects due to such an after-image can be suppressed. For this reason, in this embodiment, as shown in FIG. 3, the light guiding unit 16 is disposed upstream of the cleaning blade 14 and downstream of a primary transfer roller 31 (FIG. 1) with respect to a rotational direction (arrow direction) of the photosensitive drum 12.

[Photosensitive Unit]

Figure 5:
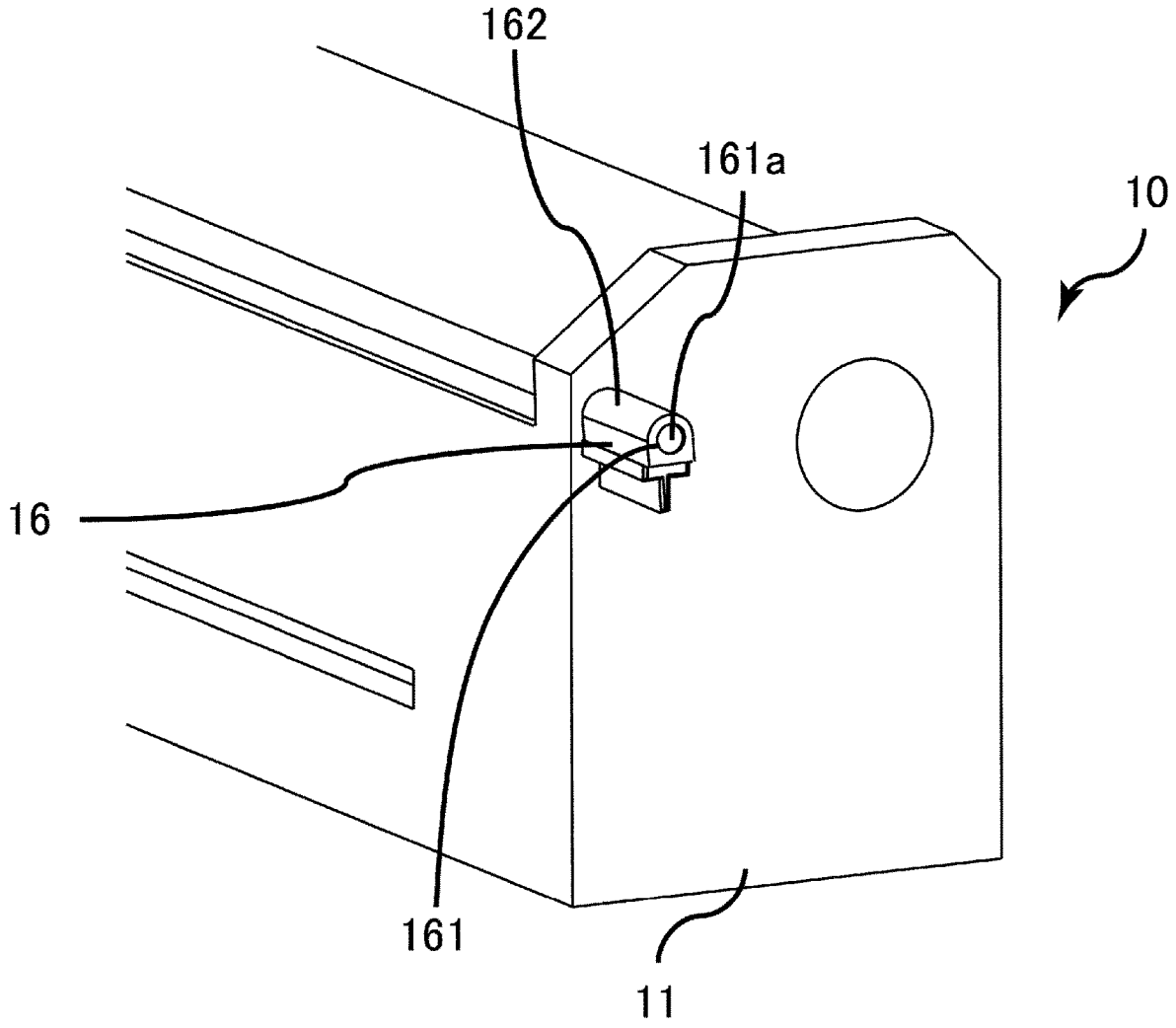
FIG. 5 is an enlarged perspective view of a part of the drum cartridge as viewed from an incident surface side of a light guiding member in the first embodiment.
Figure 6:
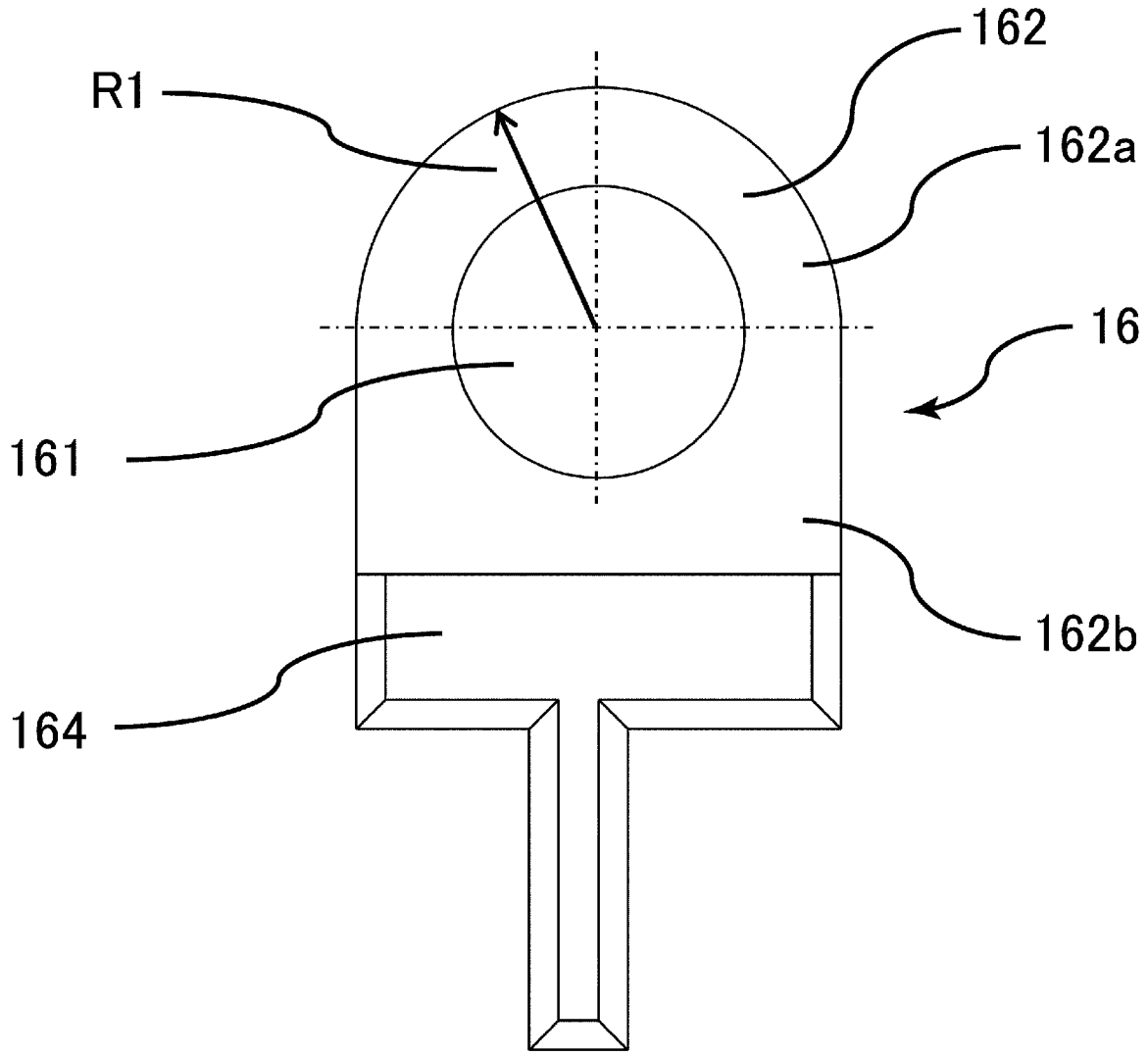
FIG. 6 is a schematic view showing an end surface of the light guiding member on the incident surface side in the first embodiment.

The light guiding unit 16 is constituted, as shown in FIGS. 5 and 6, by a bar-like light guiding member 161 comprising a light-transmitting material such as an acrylic resin and by a protective member 162 covering portions other than a portion opposing the photosensitive drum 12 at a peripheral surface of the light guiding member 161. Such a light guiding unit 16 is provided to the drum cartridge 10. The light guiding unit 16 will be specifically described.

The light guiding unit 16 is disposed along a longitudinal direction (rotational axis direction) crossing a rotational direction of the photosensitive drum 12. In this embodiment, the light guiding unit 16 is disposed at a position adjacent to the photosensitive drum 12 so as to be not only substantially parallel to the rotational axis direction of the photosensitive drum 12 but also to oppose an entire region of the photosensitive drum 12 with respect to the longitudinal direction.

Further, a part of the light guiding unit 16 at one end portion side with respect to the longitudinal direction projects outward from the drum container 11. In the case of this embodiment, the one end portion with respect to the longitudinal direction is an end portion of a rear side of the drum cartridge 10 (of the image forming apparatus 1) with respect to an insertion-extraction direction. Incidentally, a front surface (side) of the image forming apparatus 1 is a side where an operator such as a user operates the image forming apparatus 1 and is a front side on the drawing sheet of FIG. 1. On the other hand, the rear surface (side) of the image forming apparatus 1 is a side opposite from the front surface (side) and is rear (back) side on the drawing surface of FIG. 1.

On the one end portion side of the light guiding unit 16 with respect to the longitudinal direction, the portion projecting from the drum container 11 has a shape as shown in FIG. 6 in the case where this portion is viewed from the one end side with respect to the longitudinal direction. That is, the protective member 162 includes a semicircular portion 162*a* such that an upper side portion thereof with respect to a center of the light guiding member 161 has a semicylindrical shape with an outer diameter having a radius R1 and includes a rectangular portion 162*b* such that a lower side portion thereof has a substantially rectangular shape continuous with the semicircular portion 162*a*. A dimension of the rectangular portion 162*b* with respect to a left-right direction is R1×2. Further, on a side under the protective member 162, a lower portion 164 having a substantially T-shape is fixed.

The light guiding member 161 constituting the light guiding unit 16 has a substantially circular column configuration and is formed of, for example, polycarbonate, an acrylic resin, or the like which are insulating materials high in light transmissive property. The light guiding member 161 is subjected to prism processing and is formed so that light entering from an incident surface 161*a* is effectively guided to the surface of the photosensitive drum 12. That is, an end surface of the one end portion of the light guiding member 161 with respect to the longitudinal direction is the incident surface 161*a*, and the light entering the light guiding member 161 through the incident surface 161*a* is reflected toward the photosensitive drum 12 side.

For this purpose, as shown in FIG. 3, of the protective member 162 covering the light guiding member 161, a portion opposing the photosensitive drum 12 is provided with an opening 163. By this, the light entering the light guiding member 161 through the incident surface 161*a* is guided to the surface of the photosensitive drum 12 through the opening 163.

Figure 14:
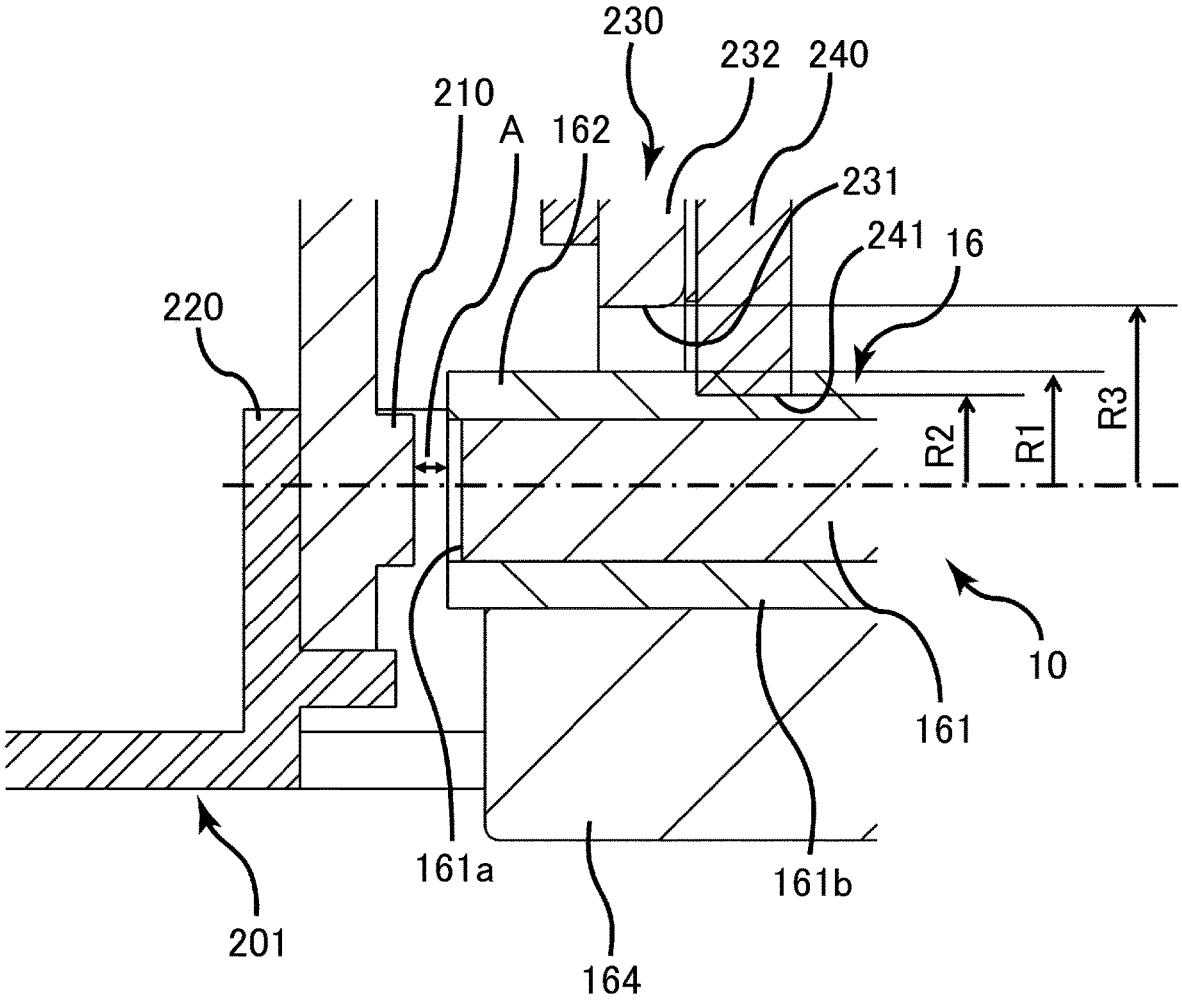
FIG. 14 is a sectional view showing the state in which the light guiding member of the drum cartridge penetrates the sealing member and the holding member and opposes the light source in the first embodiment.

Incidentally, in the case of this embodiment, the incident surface 161*a* which is the one longitudinal end side end surface of the light guiding member 161 is, as shown in FIG. 14, positioned further toward the other longitudinal side than an end surface of the protective member 162 which is an end surface of the light guiding unit 16. In other words, the protective member 162 existing near a periphery of the incident surface 161*a* is projected from the incident surface 161*a* toward the one longitudinal end side. By this, the incident surface 161*a* does not readily contact another member during a mounting operation or the like of the drum cartridge 10. However, the end surface of the protective member 162 and the incident surface 161*a* may also be positioned on the substantially same flat surface.

Further, the light guiding member 161 may also be one which is not subjected to the prism processing and may also be constituted only by the light guiding member 161 without including the protective member 162. Further, the light source (described later) may also be provided on opposite sides with respect to the longitudinal direction and the light entering the light guiding member 161 through incident surfaces of opposite surfaces may also travel toward the photosensitive drum 12.

[Light Source Unit]

Figure 7:
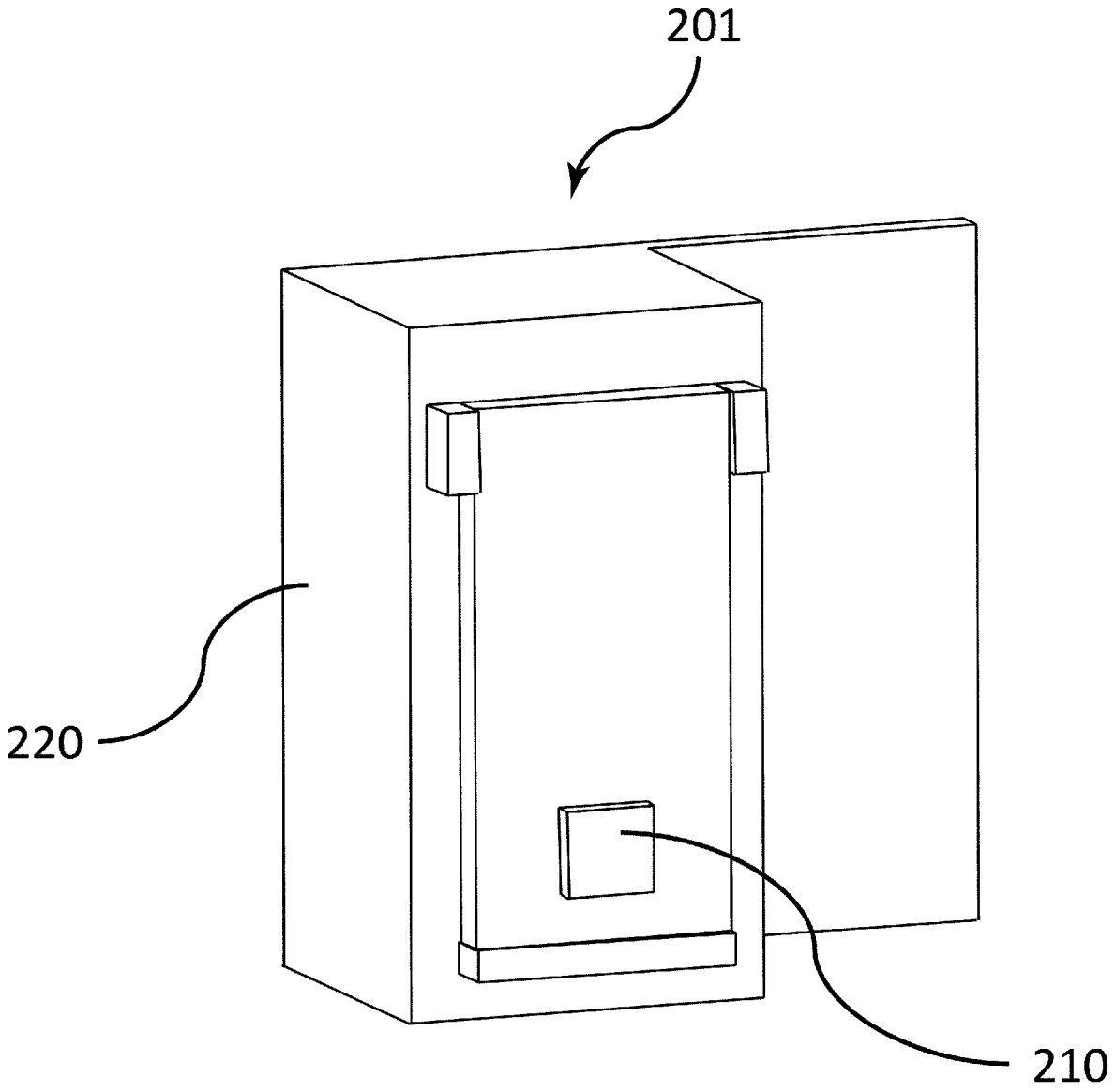
FIG. 7 is a perspective view showing a light source unit in the first embodiment.
Figure 8:
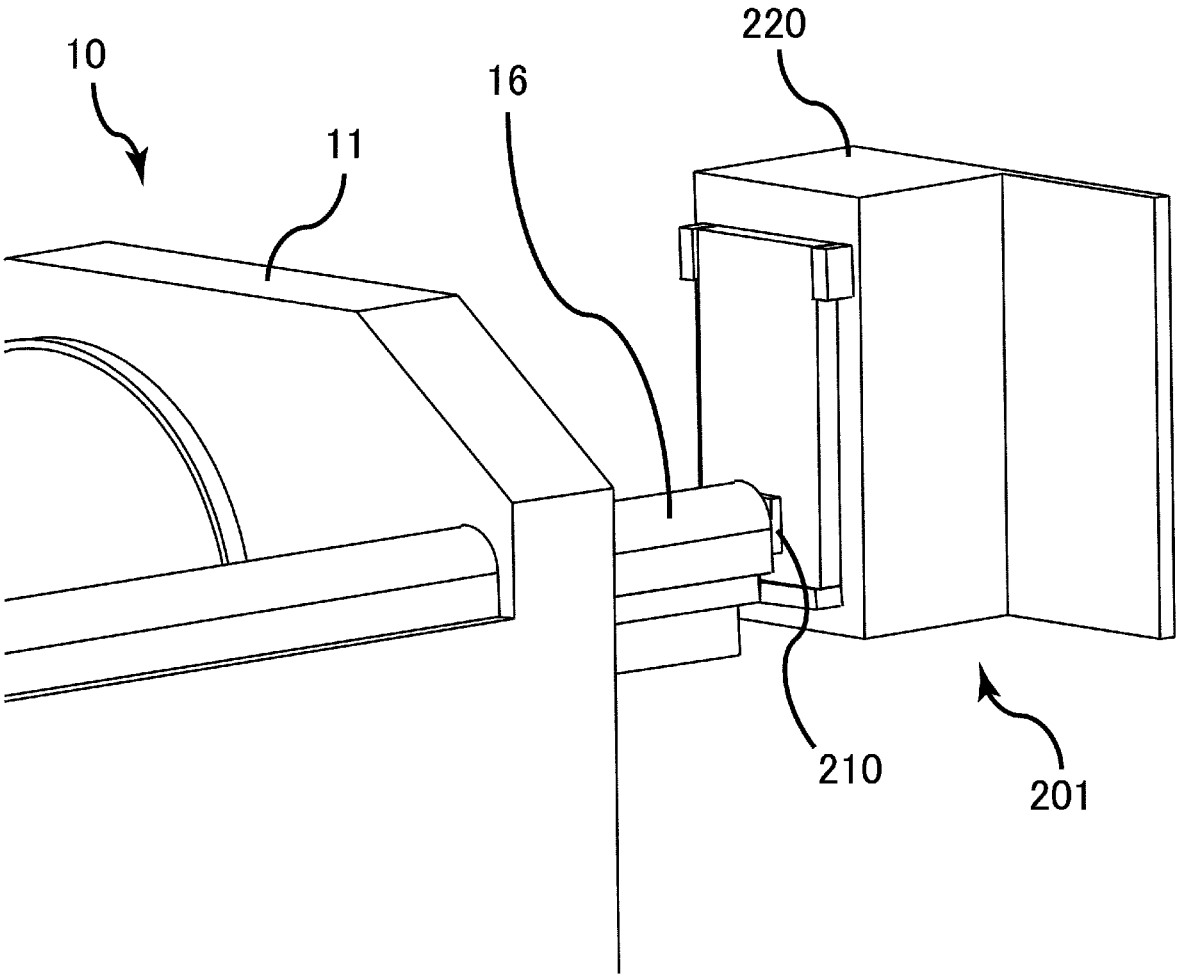
FIG. 8 is a perspective view showing a state in which the light guiding member of the drum cartridge opposes a light source in the first embodiment.
Figure 9:
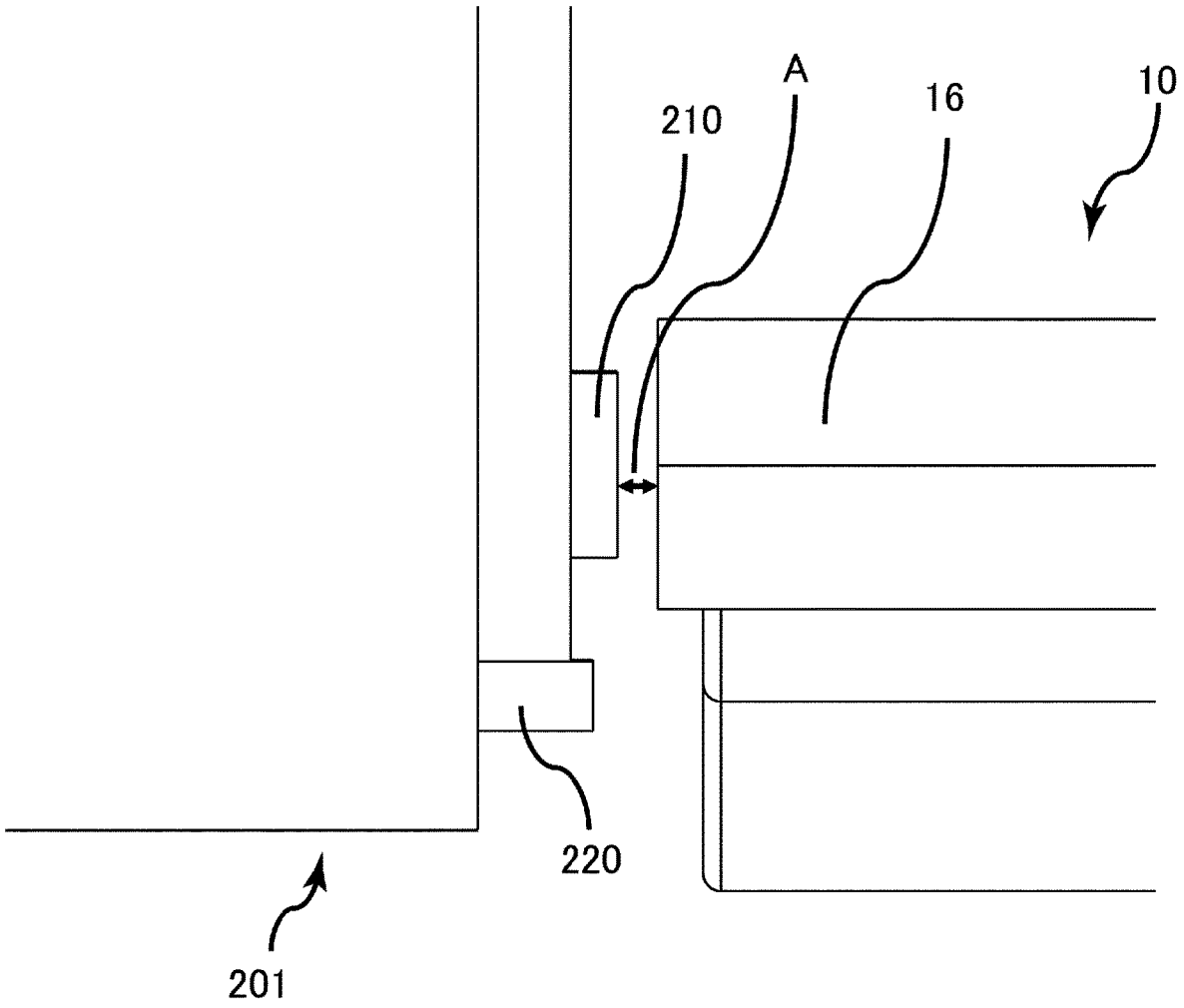
FIG. 9 is a side view showing the state in which the light guiding member of the drum cartridge opposes the light source in the first embodiment.

The light source unit 201 is provided in the apparatus main assembly 1A and emits the light toward the light guiding unit 16 of the drum cartridge 10. As shown in FIG. 7, the light source unit 201 is constituted by an LED (Light Emitting Diode) 210 as a light source and a light source holding member (casing portion) 220. As shown in FIGS. 8 and 9, the LED 210 opposes the one longitudinal end portion of the light guiding unit 16 in a state in which the drum cartridge 10 is mounted in the apparatus main assembly 1A (FIG. 1). Then, the light emitted from the LED 210 enters the light guiding member 161 of the light guiding unit 16 through the incident surface 161*a* (FIG. 5).

In this embodiment, the light source unit 201 is provided only on the one longitudinal end side of the light guiding member 161, but may also be provided on opposite sides with respect to the longitudinal direction. Further, the light source may also be a light emitting source other than the LED 210, and a shape of the LED 210 is not limited to the shape shown in FIG. 7 but may also be, for example, a head shape of a cannonball. In this embodiment, a constitution in which LED chips (LED elements) provided on an electric substrate are provided opposed to a light guiding member is employed.

As described above, the drum cartridge 10 is inserted into and extracted from the apparatus main assembly 1A along the rotational axis direction. As shown in FIG. 9, in the state in which the drum cartridge 10 is mounted in the apparatus main assembly 1A, the incident surface 161*a* of the one longitudinal end portion of the light guiding unit 16, which is an end portion on the downstream side of the drum cartridge 10 with respect to the insertion-extraction direction, and the LED 210 are provided so as to be separated from each other by a distance A. By this, it is possible to suppress breakage of the LED 210 due to contact between the LED 210 and the light guiding unit 16 caused by the insertion of the drum cartridge 10.

Here, in the drum cartridge 10, there is a liability that the toner scatters and is deposited on the LED 210. In recent years, further speed-up of a processing speed of the image forming apparatus is desired. When an image forming speed of the image forming apparatus increases, a rotational speed of the photosensitive drum also increases. In order to achieve an optically discharging effect, for the photosensitive drum rotating at high speed, equivalent to an optically discharging effect for the photosensitive drum rotating at low speed, it is required that the photosensitive drum is irradiated with light in a larger amount. For that purpose, in the case where a light emission amount of the light source is increased, a temperature of the light source in the neighborhood of a light-emitting point locally becomes high by heat generation of the light source. When a floating matter such as the toner approaches the light-emitting point, there is a liability that the toner is melted by the heat at the surface of the light source and is fixed on the light source surface. When the toner is melted and fixed on the light source surface, the light is blocked by the melt-fixed toner and an amount of the light entering the light guiding member decreases, so that optical discharge of the photosensitive drum is not sufficiently carried out and thus a lowering in image quality is invited. Therefore, in this embodiment, as described below, a gap between the LED 210 and the drum container 11 of the drum cartridge 10 is sealed by a sealing member 240.

[Sealing Member]

Figure 10:
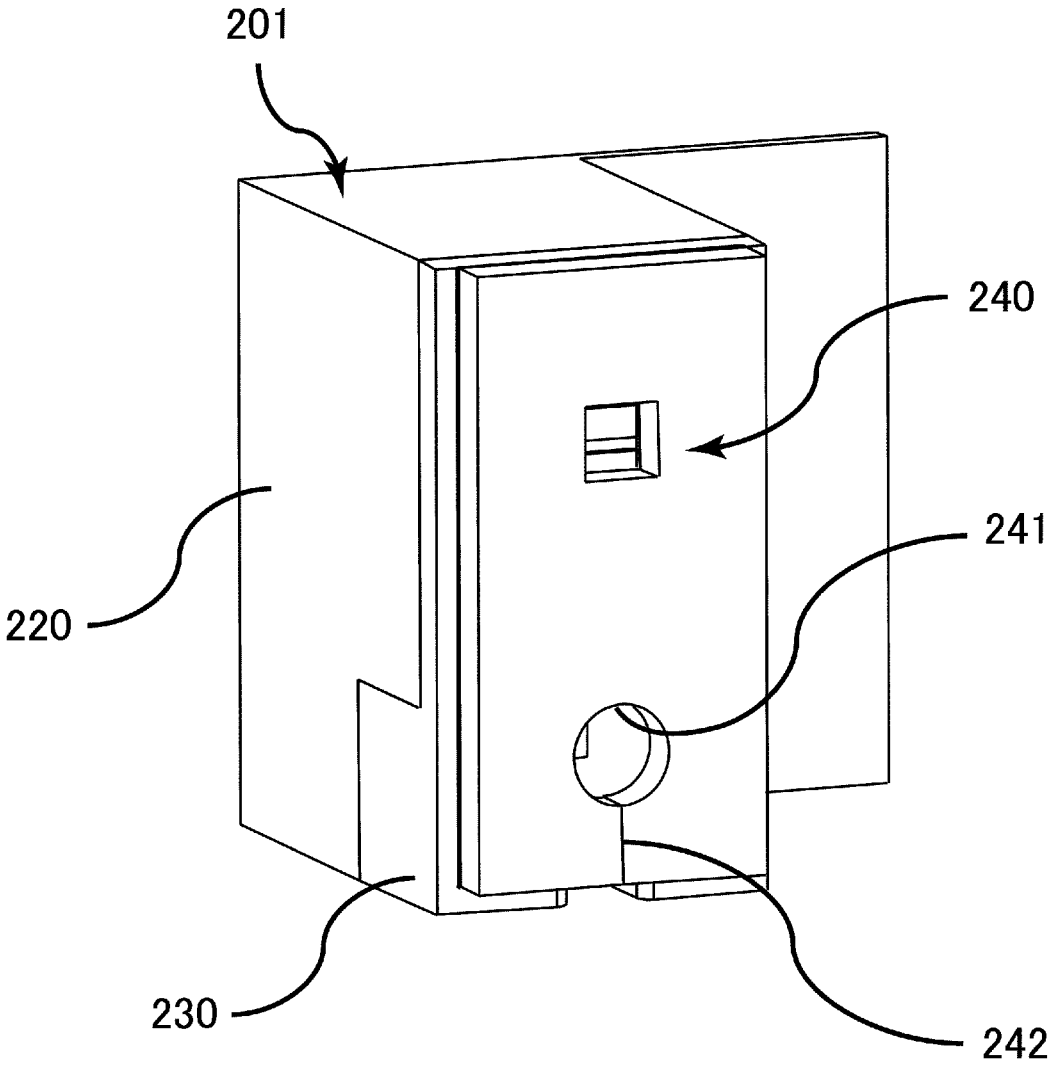
FIG. 10 is a perspective view showing a state in which a sealing member is mounted on the light source unit in the first embodiment.

Next, a sealing constitution by the sealing member 240 in this embodiment will be described using FIGS. 10 to 14. As shown in FIG. 10, in this embodiment, the light source unit 201 is provided with the sealing member (elastic member) 240 comprising a sheet-like elastic material. That is, the sealing member 240 is held by a sealing member holding member 230 as a holding member, and the sealing member holding member 230 is fixed to the light source holding member 220 by adhesive bonding or the like, for example.

The sealing member 240 is disposed on the front side (light emission side) of the LED 210. For this reason, the LED 210 has a constitution in which a periphery thereof is substantially covered with the light source holding member 220, the sealing member holding member 230 and the sealing member 240 except for a through hole 241 described below. That is, the light source holding member 220 has a function as a supporting member for supporting the LED 210, and the sealing member holding member 230 has a function as a covering member for covering the LED 210.

Figure 11:
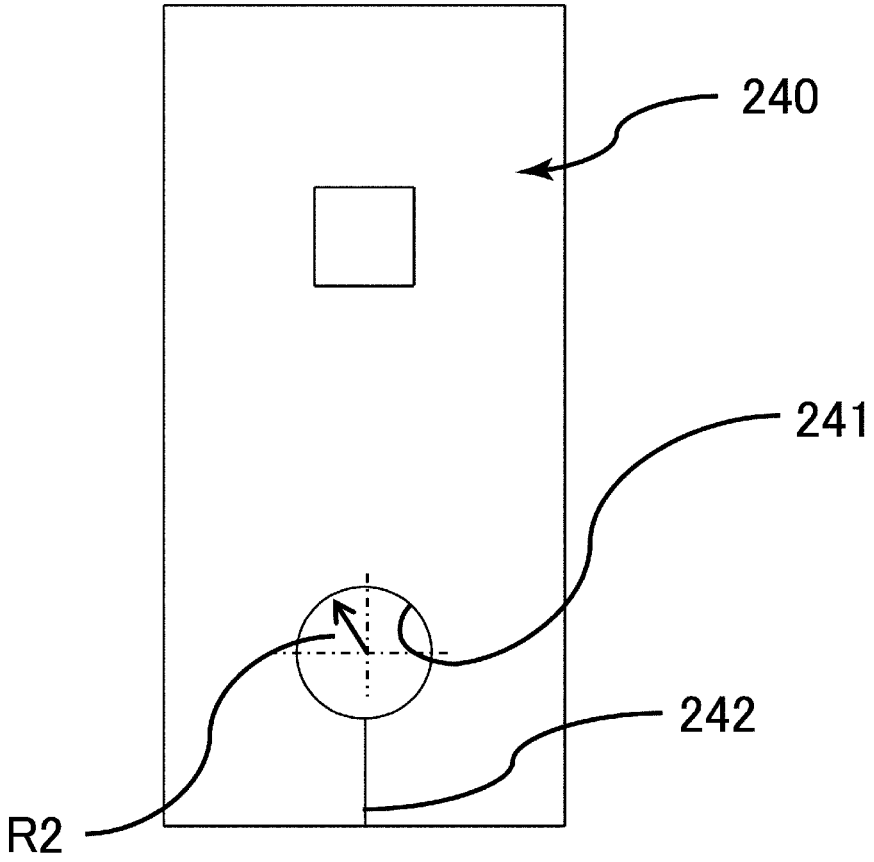
FIG. 11 is a front view of the sealing member in the first embodiment.

The sealing member 240 is formed by an elastic member including a porous resin material such as sponge and including elastomer or the like. Further, at a position of the sealing member 240 opposing the LED 210 with respect to the longitudinal direction, as shown in FIGS. 10 and 11, the through hole 241 is formed. In a free state, the through hole 241 has a substantially circular shape with a radius R2. Further, the sealing member 240 is provided with a slit 242 extending from the through hole 241 to an outer peripheral surface of the sealing member 240. The slit 242 extends downward from the through hole 241 and is continuous to a lower surface of the sealing member 240.

Figure 12:
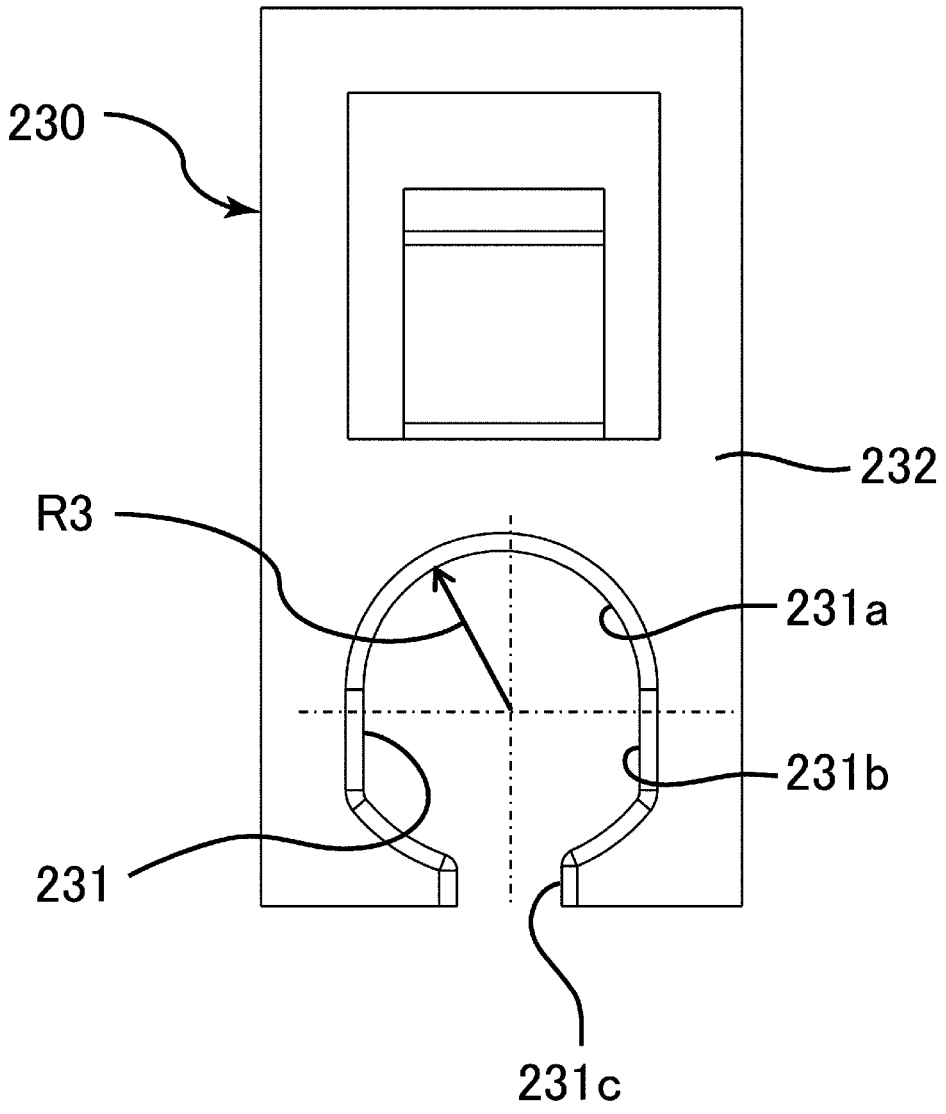
FIG. 12 is a front view of a holding member in the first embodiment.

The sealing member holding member 230 includes a passage portion 231 through which a penetration portion 161*b* of the light guiding unit 16 is capable of passing, as shown in FIGS. 12 and 14. In this embodiment, the passage portion 231 is a first through hole through which the light guiding unit 16 penetrates and is a cut-away hole. That is, the sealing member holding member 230 includes a holding plate portion 232 provided between the LED 210 and the sealing member 240. Further, at a position of the holding plate portion 232 opposing the LED 210, the passage portion 231, which is a hole penetrating the holding plate portion 232, is provided. In this embodiment, the LED 210 is sealed by the sealing member holding member 230 and the light source holding member 220. In this embodiment, a two-component (part) structure was employed, but a box-like casing portion may also be employed. Further, in this embodiment, a constitution in which the light source holding member 220 includes an LED substrate was employed, but a constitution such that the LED substrate is mounted to an outside of a casing container and LED elements are positioned in a hole provided in the casing container may also be employed.

Figure 13:
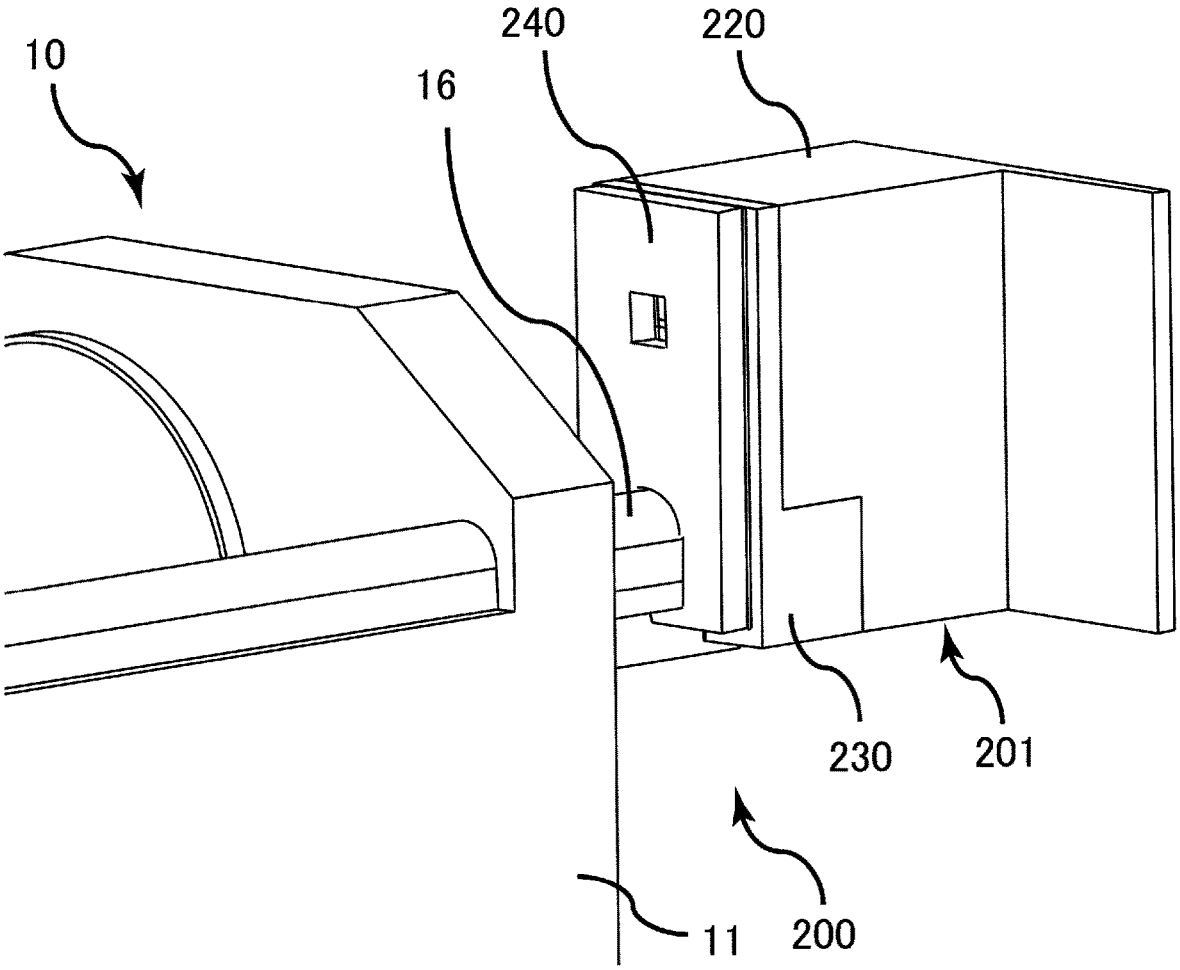
FIG. 13 is a perspective view showing a state in which the light guiding member of the drum cartridge penetrates the sealing member and the holding member and opposes the light source in the first embodiment.

When the drum cartridge 10 is inserted into the apparatus main assembly 1A, the penetration portion 161*b* which is a part projecting from the drum container 11 of the light guiding unit 16 toward a downstream side with respect to the insertion direction penetrates the through hole 241 of the sealing member 240 and the passage portion 231 of the sealing member holding member 230. Then, as shown in FIGS. 13 and 14, in a state in which a gap between the drum container 11 and the light source unit 201 is sealed by the sealing member 240, the incident surface 161*a* of the light guiding member 161 of the light guiding unit 16 is disposed opposed to the LED 210. In the following, this will be described.

The penetration portion 161*b* of the light guiding unit 16 penetrates the through hole (second through hole) 241 of the sealing member 240 when the drum cartridge 10 is inserted into the apparatus main assembly 1A. The penetration portion 161*b* is a part of the light guiding unit 16 further on the LED 210 side (light source side) than the one longitudinal end portion of the photosensitive drum 12. In this embodiment, of the light guiding unit 16, a part of the portion projecting from the one longitudinal end portion of the drum container 11 toward the LED 210 side is the penetration portion 161*b*.

An outer configuration shape of the penetration portion 161*b* is shown in FIG. 6. That is, the penetration portion 161*b* includes the semicircular portion 162*a*, the rectangular portion 162*b* and the lower portion 164. A center of the LED 210, a center of the through hole 241 and a center of the semicircular portion 162*a* of the penetration portion 161*b* substantially coincide with each other as viewed in the longitudinal direction. The center of the semicircular portion 162*a* coincides with a center of the light guiding member 161. For this reason, in a state in which the drum cartridge 10 is mounted in the apparatus main assembly 1A, as shown in FIG. 14, the incident surface 161*a* of the light guiding member 161 opposes the LED 210 in a state in which the center of the light guiding member 161 substantially coincides with the center of the LED 210.

Such a through hole 241 is made smaller in cross-sectional shape than the penetration portion 161*b* of the light guiding unit 16. That is, in the case where the cross-sectional shape of the penetration portion 161*b* which is a part of the light guiding unit 16 is projected on the sealing member 240 with respect to the longitudinal direction, the through hole 241 in a state (free state) in which the penetration portion 161*b* penetrates the through hole 241 falls within a range of the cross-sectional shape of the penetration portion 161*b*. And, a cross-sectional area of the through hole 241 is smaller than a cross-sectional area of the light guiding unit 16 perpendicular to the longitudinal direction of the light guiding unit 16. In this embodiment, the light guiding unit 16 has the same cross-sectional area over the longitudinal direction. In the case where the light guiding unit 16 does not have the same cross-sectional area, the cross-sectional area of the through hole 241 is smaller than the cross-sectional area in a region of the above-described elastic member when the light guiding unit 16 is mounted in the image forming apparatus 1.

Specifically, the radius R2 of the through hole 241 in the free state shown in FIG. 11 is made smaller than the radius R1 of the semicircular portion 162*a* of the light guiding unit 16 shown in FIG. 6. That is, as shown in FIG. 14, R1>R2 holds. Incidentally, the through hole 241 of the sealing member 240 shown in FIG. 14 is in the free state. In this embodiment, R1=2.5 mm and R2=2.0 mm were set.

By employing such a constitution, when the penetration portion 161*b* of the light guiding unit 16 penetrates the through hole 241, the sealing member 240, which is the elastic member, is deformed so as to follow the outer configuration of the penetration portion 161*b*. As a result, an inner peripheral surface of the through hole 241 elastically contacts an outer peripheral surface of the penetration portion 161*b* penetrating the through hole 241. Then, by the sealing member 240, a gap between the LED 210 and the drum cartridge 10 that is disposed further on the other longitudinal end side than the penetration portion 161*b*, i.e., on a side upstream of the penetration portion 161*b* with respect to the insertion direction, is formed. In this embodiment, the gap between the LED 210 and the drum container 11 in which the photosensitive drum 12 is disposed is sealed with the sealing member 240.

Particularly, in the case of this embodiment, the penetration portion 161*b* which is the part of the light guiding unit 16 penetrates the through hole 241 of the sealing member 240. For this reason, when the drum cartridge 10 is mounted in the apparatus main assembly 1A, it is possible to suppress that a part of the sealing member 240 is deformed and blocks a part of the incident surface 161*a* of the light guiding member 161. Further, a sealing property can be enhanced by bringing the inner peripheral surface of the through hole 241 into elastic contact with the outer peripheral surface of the through hole 241. For this reason, in the constitution in which the drum cartridge 10 is mounted in the apparatus main assembly 1A, it is possible to suppress not only deposition of the toner on the LED 210 but also a lowering in amount of the light incident on the light guiding member 161.

Further, the sealing member 240 is the elastic member and is provided with the slit 242, so that when the penetration portion 161*b* penetrates the through hole 241, the sealing member 240 is elastically deformed and the slit 242 opens. For this reason, a reaction force by deformation of the sealing member 240 when the penetration portion 161*b* is passed through the through hole 241 is very small, so that it is possible to suppress damage on an exchange operation property of the drum cartridge 10.

The passage portion 231 of the sealing member holding member 230 has a shape as shown in FIG. 12 as viewed from the one longitudinal side. That is, the passage portion 231 is a hole formed by a semicircular portion 231*a* having a semicylindrical shape with an outer diameter having a radius R3, a rectangular portion 231*b* having a substantially rectangular shape continuous to the semicircular portion 231*a*, and a cut-away portion 231*c* which opens downward from a lower side of the rectangular portion 231*b*. A dimension of the rectangular portion 231*b* with respect to the left-right direction is substantially equal to R3×2. A center of the semicircular portion 231*a* coincides with the center of the through hole 241, and the cut-away portion 231*c* is formed at a position corresponding to the slit 242.

In the case of this embodiment, the passage portion 231 is made larger in cross-sectional shape than the penetration portion 161*b*. That is, the cross-sectional shape of the penetration portion 161*b* which is a part of the light guiding unit 16 is projected on the sealing member holding member 230 with respect to the longitudinal direction, the cross-sectional shape of the penetration portion 161*b* falls within the range of the passage portion 231 and an area (cross-sectional area) of the passage portion 231 is larger than the cross-sectional area of the penetration portion 161*b*. Specifically, the radius R3 of the semicircular portion 231*a* of the passage portion 231 is made larger than the radius R1 of the semicircular portion 162*a* of the light guiding unit 16 shown in FIG. 6. That is, as shown in FIG. 14, R3>R1 holds. In this embodiment, R3=4 mm was set.

By employing such a constitution, the passage portion 231 has a gap between itself and the outer peripheral surface of the light guiding unit 16 passed through the passage portion 231, i.e., the outer peripheral surface of the penetration portion 161*b*. As a result, when the drum cartridge 10 is mounted in and dismounted from the apparatus main assembly 1A, it is possible to suppress that the penetration portion 161*b* of the light guiding unit 16 interferes with the sealing member holding member 230, so that a mounting and dismounting operation of the drum cartridge 10 can be smoothly performed.

Incidentally, in the case of this embodiment, the gap between the passage portion 231 of the sealing member holding member 230 and the penetration portion 161*b* of the light guiding unit 16 is roughly 1.5 mm. On the other hand, a dimensional difference (thickness) between the inner peripheral surface of the passage portion 231 and the inner peripheral surface of through hole 241 of the sealing member 240 is roughly 2 mm. Accordingly, in a state in which the penetration portion 161*b* of the light guiding unit 16 penetrates the through hole 241 and the passage portion 231, the sealing member 240 is elastically deformed by roughly 0.5 mm and contacts the outer peripheral surface of the penetration portion 161*b*. For this reason, a sealing property by the sealing member 240 can be further enhanced.

By employing the above-described constitution of this embodiment, the sealing property of the LED 210 by the sealing member 240 can be enhanced without impairing the exchange operation property of the drum cartridge 10. As a result, a degree of entrance of the toner into the light emitting portion of the LED 210 is decreased, so that it is possible to suppress sticking of the toner onto the surface of the LED 210.

Incidentally, in this embodiment, the shape of the passage portion 231 and the cross-sectional shape of the light guiding unit 16 are as described above, but may also be changed to a circular shape, an elliptical shape, a combination of a plurality of arcuate shapes, or a polygonal shape. In this case, the shape of the through hole 241 of the sealing member 240 may be the shape which conforms to these shapes or may also be a circular shape irrespective of these shapes. In summary, the shape of the through hole 241 may only be required to be a shape such that the inner peripheral surface of the through hole 241 of the sealing member 240 elastically contacts the outer peripheral surface of the penetration portion 161*b* of the light guiding unit 16 over a substantially full circumference of the penetration portion 161*b*.

Second Embodiment

A second embodiment will be described with reference to FIGS. 15 to 19. In the above-described first embodiment, the LED 210 was fixed, but in this embodiment, a constitution in which the LED 210 is movably supported is employed. Other constitutions and functions are similar to those in the first embodiment, and therefore, the same constituent elements are represented by the same reference numerals or symbols and will be omitted from description or will briefly described. In the following, a difference of this embodiment from the first embodiment will be principally described.

Figure 15:
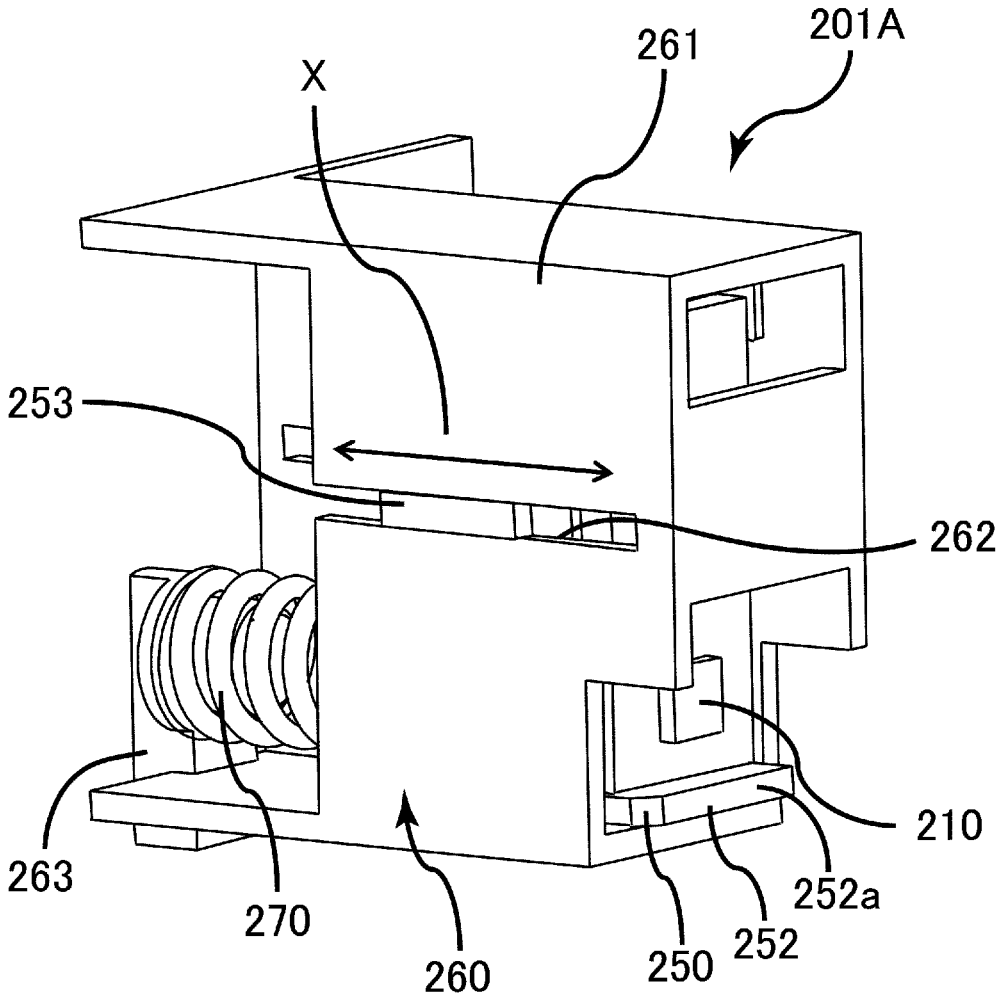
FIG. 15 is a perspective view of a light source unit in a second embodiment.
Figure 18:
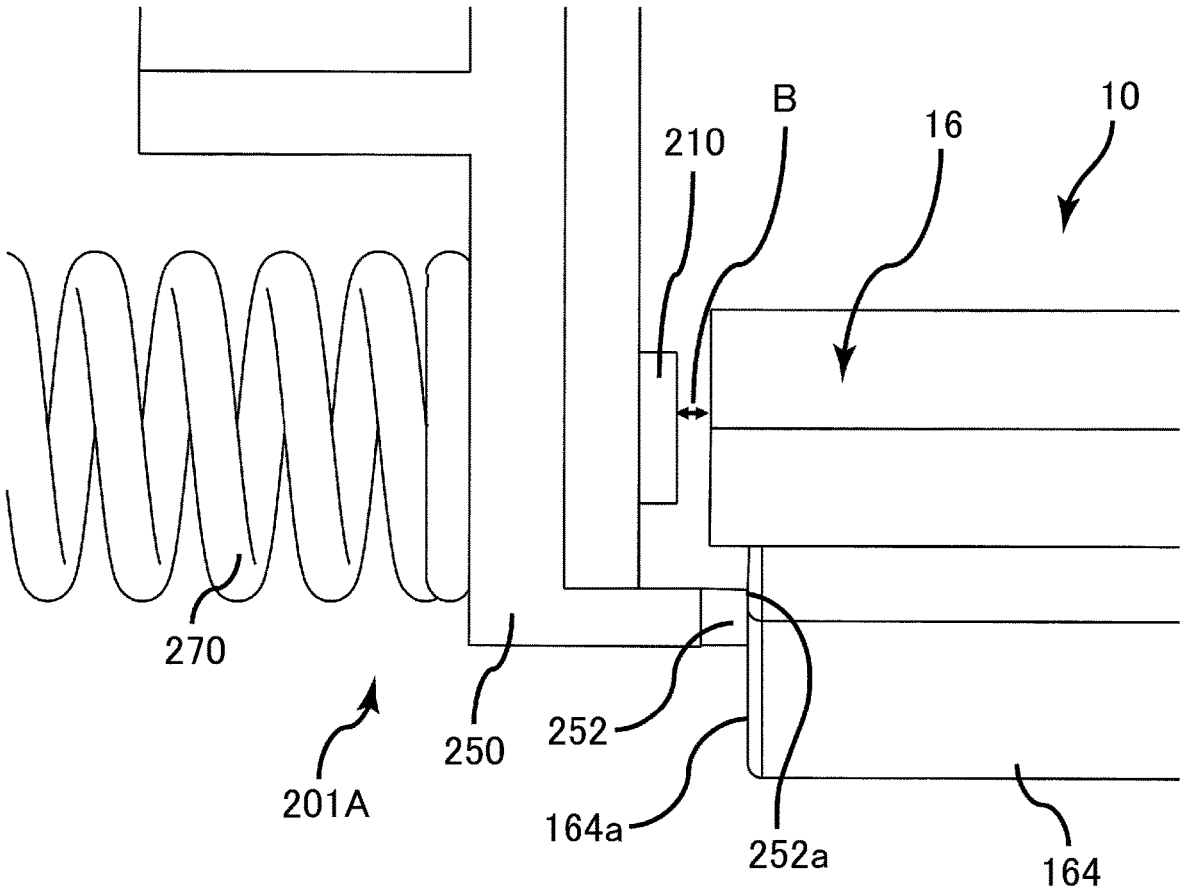
FIG. 18 is a side view showing the state in which the light guiding member of the drum cartridge opposes the light source in the second embodiment.
Figure 19:
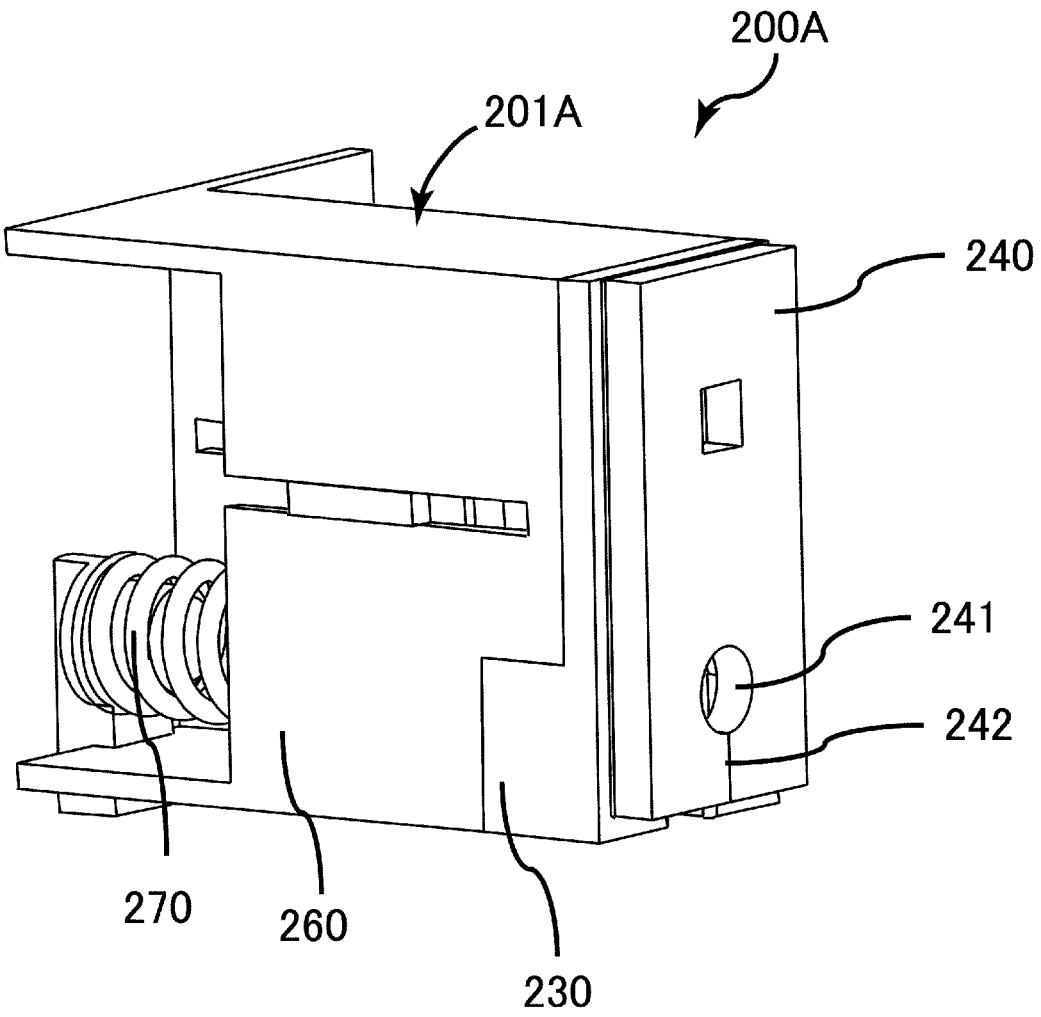
FIG. 19 is a perspective view showing a state in which a sealing member is mounted on the light source unit in the second embodiment.

An optical discharging device 200A in this embodiment includes, as shown in FIG. 19, a light guiding unit 16 (FIGS. 17 and 18), a light source unit 201A and a sealing member 240. In FIG. 19, the light guiding unit 16 is omitted. The light source unit 201A is provided in the apparatus main assembly 1A (FIG. 1), and as shown in FIG. 15, includes the LED 210 as a light source, a supporting member 250 supporting the LED 210, a light source holding member 260, and a spring 270 as an urging means.

Figure 16:
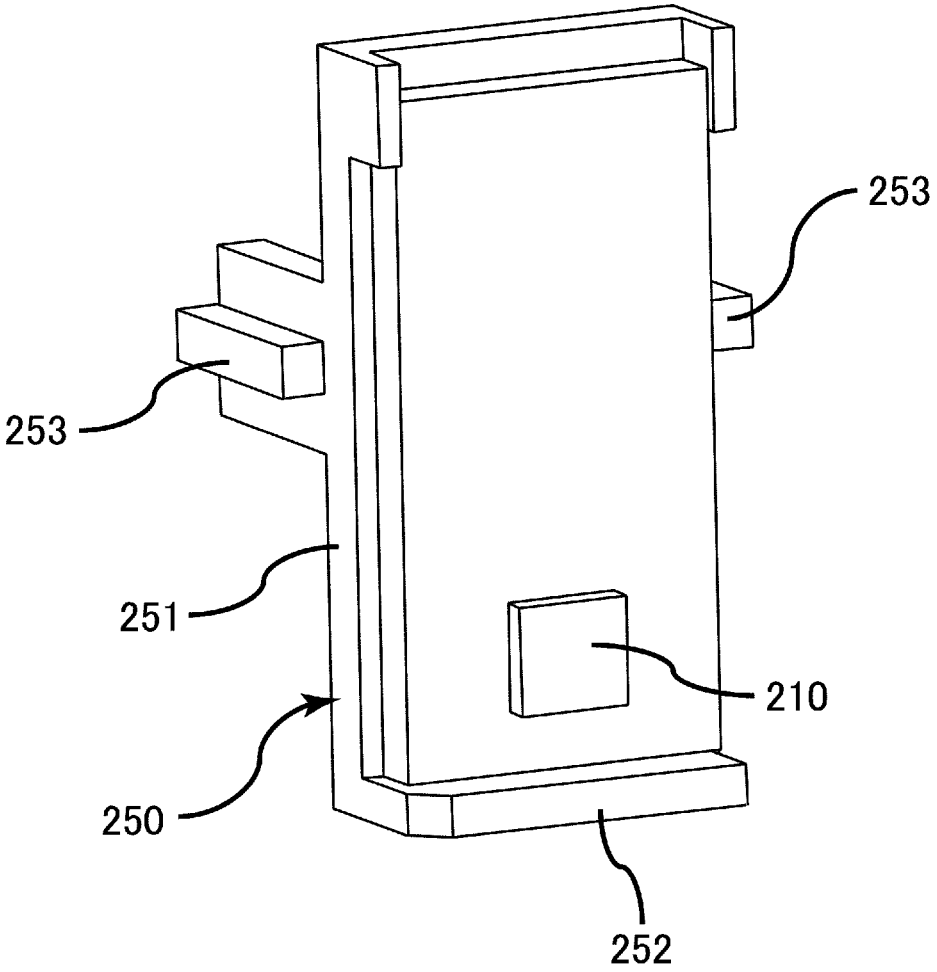
FIG. 16 is a perspective view of a supporting member in the second embodiment.

The supporting member 250 includes, as shown in FIG. 16, a supporting plate portion 251, a projected portion 252 and a guiding portion 253. The supporting plate portion 251 is a plate-like portion disposed with respect to a substantially vertical direction and supports the LED 210 on one surface thereof. The projected portion 252 is formed so as to project from a lower end portion of the supporting plate portion 251 further to a front side (light emission side) than the LED 210. The projected portion 252 as a contact portion is contacted at a free end surface 252*a* thereof to the one longitudinal end portion of the light guiding unit 16 when the drum cartridge 10 is mounted in the apparatus main assembly 1A, as described above. Further, a predetermined gap is formed between the LED 210 and the one longitudinal end portion of the light guiding unit 16. The guiding portion 253 has a projected shape formed by being provided substantially parallel to the longitudinal direction on each of opposite sides of the supporting plate portion 251 with respect to a widthwise direction perpendicular to each of the vertical direction and the longitudinal direction.

Figure 17:
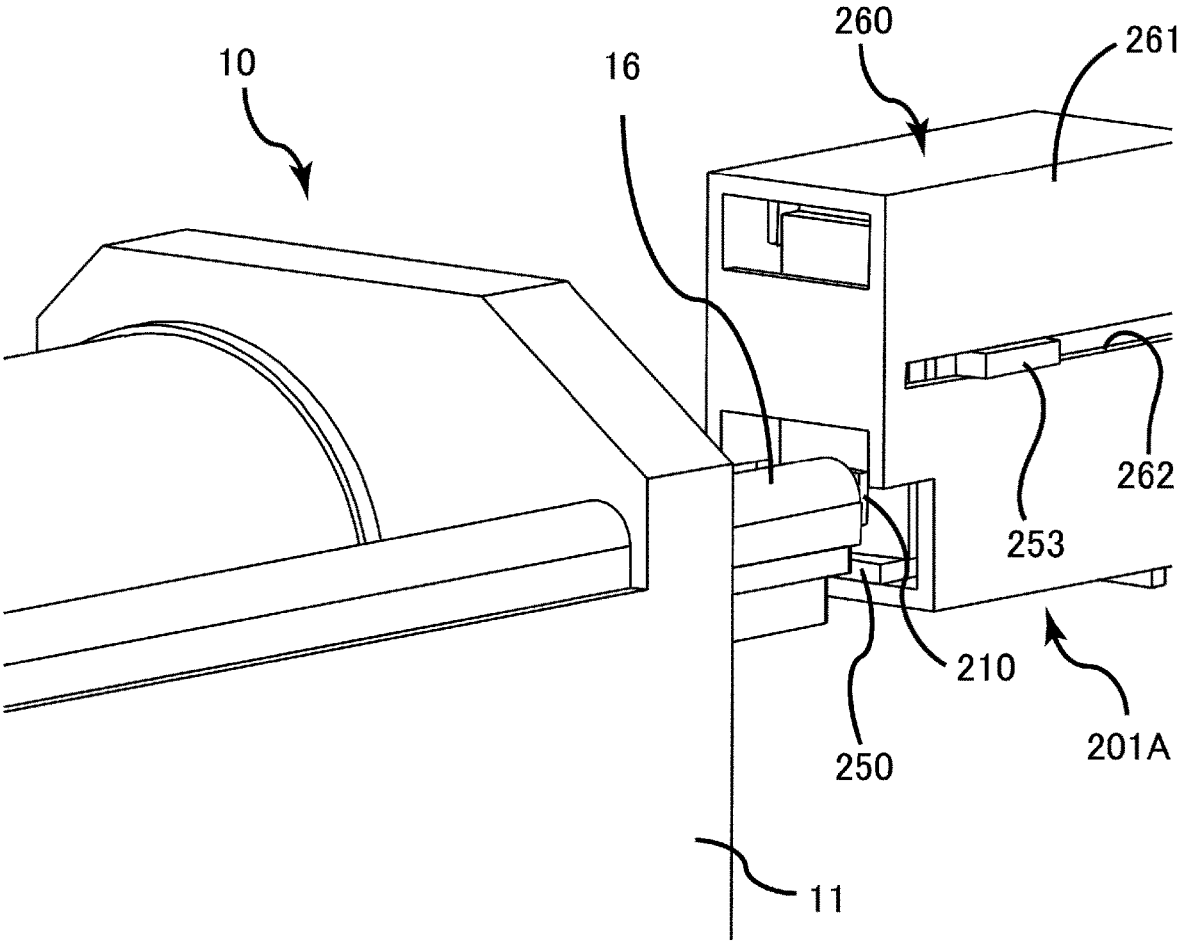
FIG. 17 is a perspective view showing a state in which a light guiding member of a drum cartridge opposes a light source in the second embodiment.

The light source holding member 260 is provided in the apparatus main assembly 1A and movably holds the supporting member 250 in the longitudinal direction. That is, also in the case of this embodiment, the drum cartridge 10 is mountable in and dismountable from the apparatus main assembly 1A in the longitudinal direction, so that the LED 210 supported by the supporting member 250 is movable in the same direction as a mounting-dismounting direction (insertion-extraction direction X of FIG. 15) of the drum cartridge 10. Such a light source holding member 260 includes, as shown in FIGS. 15 and 17, an accommodating portion 261 accommodating the supporting member 250 supporting the LED 210 and an engaging guiding portion 262 engageable with the guiding portion 253 of the supporting member 250 and for guiding the guiding portion 253 in the longitudinal direction.

In the case of this embodiment, the engaging guiding portion 262 is a cut-away portion cut away along the longitudinal direction of a side plate constituting the accommodating portion 261. Further, by inserting the projected guiding portion 253 into the cut-away portion, the guiding portion 253 and the engaging guiding portion 262 are engaged with each other. The engaging guiding portion 262 is formed on each of opposite sides of the supporting member 250 with respect to the widthwise direction similarly as in the case of the guiding portion 253, and is engaged with the guiding portion 253 on each of the opposite sides, and thus movably supports the supporting member 250 with respect to the longitudinal direction (insertion-extraction direction X). In this state, the supporting member 250 is in a float state from a bottom plate of the light source holding member 260 at a lower end portion thereof.

The spring 270 urges the supporting member 250 supporting the LED 210 in a direction opposite to the mounting direction of the drum cartridge 10, i.e., toward the other longitudinal end side. That is, as shown in FIGS. 15 and 18, the spring 270 is disposed in an elastically compressed state between the supporting member 250 and a fixing portion 263 fixed to the light source holding member 260 and urges the supporting member 250 toward the other longitudinal end side.

Thus, in the case of this embodiment, a constitution in which the LED 210 is supported by the supporting member 250 movable in the insertion-extraction direction X of the drum cartridge 10 and is urged by the spring 270 toward a side opposite to the insertion direction of the drum cartridge 10 into the apparatus main assembly 1A is employed. Here, also in the case of this embodiment, as shown in FIG. 6, the light guiding unit 16 includes the lower portion 164. The lower portion 164 is provided at a position opposing the projected portion 252 when the drum cartridge 10 is mounted in the apparatus main assembly 1A. Further, as shown in FIG. 18, when the drum cartridge 10 is mounted in the apparatus main assembly 1A, an abutment surface 164*a* of the lower portion 164 abuts against the free end surface 252*a* of the projected portion 252 of the supporting member 250.

For this reason, during mounting of the drum cartridge 10, after the abutment surface 164*a* of the light guiding unit 16 abuts against the free end surface 252*a* of the projected portion 252 of the supporting member 250 supporting the LED 210, the light guiding unit 16 and the LED 210 move integrally with each other. Further, at this time, the free end surface 252*a* and the abutment surface 164*a* contact each other so as to provide a predetermined gap (distance B) between the LED 210 and the one longitudinal end portion of the light guiding unit 16. For this reason, irrespective of a variation in mounting position of the drum cartridge 10 and a dimensional variation of the light guiding unit 16, it is possible to reduce a variation in distance (gap) between the LED 210 and the incident surface 161*a* of the light guiding unit 16.

In the case of the above-described first embodiment, the LED 210 is fixed, and therefore, it is desired that the distance A between the incident surface 161*a* and the LED 210 is set in consideration of the variation in mounting position of the drum cartridge 10 or the like. On the other hand, in the case of this embodiment, the LED 210 is movable in the longitudinal direction, and therefore, even when the mounting position of the drum cartridge 10 somewhat shifts, the LED 210 follows and moves along the drum cartridge 10. For this reason, the distance B between the incident surface 161*a* and the LED 210 can be made smaller than the distance A in the first embodiment.

Thus, in the case of this embodiment, it is possible to not only reduce the variation in distance B between the LED 210 and the incident surface 161*a* of the light guiding unit 16, but also decrease the distance B. For this reason, it is possible to not only stabilize an amount of the light emitted from the LED 210 toward the light guiding unit 16, but also decrease loss of the amount of the light. As a result, a degree of a variation in amount of optical discharge light with which the photosensitive drum 12 is irradiated through the light guiding unit 16 can be reduced, so that it is possible to not only achieve a stable (optically) discharging effect, but also realize high efficiency of the optical discharging device.

Also, in such a case of this embodiment, as shown in FIG. 19, by the sealing member 240 similar to the sealing member 240 in the first embodiment, the gap between the LED 210 and the drum container 11 in which the photosensitive drum 12 is disposed is sealed. Accordingly, similarly as in the first embodiment, it is possible to not only enhance the sealing property of the LED 210 without impairing the exchange operation property of the drum cartridge 10 but also realize reduction of the degree of the variation in discharge light amount and high efficiency of the optical discharging device.

Incidentally, a floating constitution of the LED 210 described in this embodiment is an example, and does not restrict a guide shape and an urging means and the like which relate to the floating constitution.

Other Embodiments

In the cases of the above-described embodiments, as the optical discharging devices, the constitutions in which the residual electric charges on the photosensitive drum are removed by irradiating the photosensitive drum surface with light in a range downstream of the primary transfer roller and upstream of the cleaning blade with respect to the rotational direction of the photosensitive drum were described. However, the present invention may also employ a constitution in which the photosensitive drum surface is irradiated with light by the optical discharging device before the toner image is transferred from the photosensitive drum onto the intermediary transfer belt. In this case, the light guiding member is disposed downstream of the developing device and upstream of the primary transfer roller with respect to the rotational direction of the photosensitive drum.

In the case of the above-described embodiments, the constitution in which the photosensitive unit is the drum cartridge was described. However, the photosensitive unit may also be a process cartridge in which the drum cartridge and the developing device are integrally assembled into a unit mountable and dismountable from the apparatus main assembly.

Further, in the above-described embodiments, the constitution in which the light guiding member is integrally assembled with the photosensitive unit was employed, but a constitution in which the light guiding unit is provided in the apparatus main assembly of the image forming apparatus in which the photosensitive unit is mountable in and dismountable from the apparatus main assembly may also be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-029865 filed on Feb. 25, 2020, which is hereby incorporated by reference herein in its entirety.

What is claimed is:

1. An image forming apparatus comprising:

a photosensitive member on which an electrostatic image is formed;

a light source;

a light guiding unit including a light guiding member configured to guide light from said light source so that the light enters one end portion of said light guiding unit with respect to a longitudinal direction of said light guiding unit and travels toward said photosensitive member so as to optically discharge said photosensitive member;

a casing portion provided with a first through-hole and configured to cover said light source; and a sheet-like elastic member which is provided on a surface of said casing portion where said first through-hole is provided and which is provided with a second through-hole, wherein said light guiding unit penetrates said first through-hole and said second through-hole, and the one end portion of said light guiding unit opposes said light source and is positioned inside said casing portion, and wherein at a flat surface of said light guiding unit perpendicular to the longitudinal direction of said light guiding unit, an area of said second through-hole is smaller than an area of said light guiding unit.

2. An image forming apparatus according to claim 1, wherein said light guiding unit includes said light guiding member and a supporting portion for supporting said light guiding member.

3. An image forming apparatus according to claim 1, wherein said first through-hole is a cut-away hole.

4. An image forming apparatus according to claim 1, wherein said elastic member includes a slit extending from said second through-hole to an outer peripheral surface of said elastic member.

5. An image forming apparatus according to claim 1, wherein said light source is provided on a surface opposing said first through-hole.

6. An image forming apparatus according to claim 1, further comprising a stopper configured to position said light guiding unit with respect to the longitudinal direction, said stopper being in contact with said light guiding unit.

7. An image forming apparatus according to claim 1, further comprising a photosensitive unit including said photosensitive member and said light guiding unit, said photosensitive unit being mountable in and dismountable from said image forming apparatus.

8. An image forming apparatus according to claim 7, wherein a part of said light guiding unit penetrating said first through-hole and said second through-hole is provided at a downstream end of said photosensitive unit with respect to an inserting direction of said photosensitive unit into said image forming apparatus.

9. An image forming apparatus according to claim 1, wherein said elastic member comprises a sponge.

10. An image forming apparatus according to claim 1, wherein said light source comprises an LED including an element facing said light guiding member.

11. An image forming apparatus according to claim 1, wherein said casing portion is formed by a supporting member for supporting said light source and a sealing member for sealing said light source in engagement with said supporting member.

* * * * *